US006695292B2

(12) United States Patent
Nam

(10) Patent No.: US 6,695,292 B2
(45) Date of Patent: Feb. 24, 2004

(54) SAFETY DEVICE FOR AIR BALANCING HOIST

(75) Inventor: Sang Kyung Nam, Kwangmyung (KR)

(73) Assignee: Korea Hoist Co. Ltd., Anshan (KR)

( * ) Notice: Subject to any disclaimer, the term of this patent is extended or adjusted under 35 U.S.C. 154(b) by 0 days.

(21) Appl. No.: 09/989,939

(22) Filed: Nov. 21, 2001

(65) Prior Publication Data

US 2003/0047726 A1 Mar. 13, 2003

(30) Foreign Application Priority Data

Sep. 12, 2001 (KR) ..... 2001-56063

(51) Int. Cl.[7] ..... B66D 5/04
(52) U.S. Cl. ..... 254/267; 254/360
(58) Field of Search ..... 254/267, 331, 254/360, 376

(56) References Cited

U.S. PATENT DOCUMENTS

| | | | | | |
|---|---|---|---|---|---|
| 4,489,919 | A | * | 12/1984 | Ostrobrod | 254/346 |
| 4,511,123 | A | * | 4/1985 | Ostrobrod | 254/364 |
| 4,520,998 | A | * | 6/1985 | Flaig | 254/267 |
| 5,127,631 | A | * | 7/1992 | Flaig | 254/267 |
| 5,458,318 | A | * | 10/1995 | Jussila | 254/267 |
| 5,522,581 | A | | 6/1996 | Kulhavy | |
| 5,553,832 | A | | 9/1996 | Zaguroli, Jr. | |
| 2001/0022358 | A1 | * | 9/2001 | Heun et al. | 254/267 |

* cited by examiner

*Primary Examiner*—Kathy Matecki
*Assistant Examiner*—Evan Langdon
(74) *Attorney, Agent, or Firm*—Dilworth & Barrese LLP

(57) ABSTRACT

The present invention relates to a safety device for an air balancing hoist for braking and finally stopping a reel drum in such a manner that upon fast rotation of the reel drum during a lifting-up operation, a braking pawl attached to the reel drum is locked into a ratchet wheel secured on an end cap due to centrifugal force. The air balancing hoist includes a housing 102 with a chamber 101, which compressed air is introduced into and discharged from, formed therein and with end caps 104, 111 mounted on both ends of the housing, a piston 105 reciprocating along an inner periphery of the housing 102, a ball screw 106 installed in the housing 102 so that it penetrates the piston 105 and is secured to the end caps 104, 111 so as not to rotate, and a reel drum 110 with one end thereof rotatably supported by the piston 105 through a bearing 107 and with the other end thereof secured on a ball nut 108 rotatably engaged with the ball screw 106 so that the reel drum is rotated when moving along the ball screw 106. The safety device includes a braking wheel 114 secured on an inner surface of the end cap 111 and with ratchet 113 longitudinally formed on an outer surface of the wheel over the length corresponding to a range of movable distance of the reel drum 110; and a braking pawl 115 radially pivotably mounted on a side of the reel drum 110 to be releasably locked into the ratchet 113 for braking the reel drum 110 upon fast rotation of the reel drum 110 during the lifting-up operation.

13 Claims, 5 Drawing Sheets

SAFETY DEVICE FOR AIR BALANCING HOIST

BACKGROUND OF THE INVENTION

1. Field of the Invention

The present invention relates to a safety device for an air balancing hoist, which can prevent a sudden rise of a hook of the hoist due to rapid expansion of compressed air when a load or workpiece is accidentally loosed or released from the hook while performing a lifting-up operation using the air balancing hoist for lifting or lowering the load or workpiece through forward or reverse rotation of a reel drum on which a wire is wound by means of supply of the compressed air.

More specifically, the present invention relates to a safety device for an air balancing hoist, wherein upon sudden rotation of a reel drum due to accidental release of a load or workpiece from a hook during a lifting-up operation, a braking pawl attached to the reel drum is moved in an outward radial direction due to centrifugal force and then locked into a ratchet wheel fixed to an end cap, thereby braking the reel drum.

2. Description of the Prior Art

As schematically shown in FIG. 1, a conventional air balancing hoist includes a cylindrical housing 2 with a chamber 1, which compressed air is introduced into or discharged from, formed therein; a ball screw 5 centrally positioned in the housing 2 and with both ends thereof secured by fastening members 3, 4 so as not to rotate; and an end cap 7 mounted on one end of the housing 2 to hermetically seal the chamber 1 and provided with a manifold 6 attached to an outer side of the end cap. The manifold 6 has holes through which the compressed air is introduced and discharged.

The air balancing hoist further includes a piston 8 reciprocating along an inner periphery of the housing 2 by means of the compressed air introduced into and discharged from the chamber 1 through the manifold 6, and a reel drum 12 with one end thereof secured on a ball nut 9 engaged with the ball screw 5 to be movable along the ball screw and with the other end thereof rotatably supported by the piston 8 through a thrust bearing 10. Upon operation of the piston 8, the reel drum 12 rotates while moving along the ball screw 5 and thus winds or unwinds the wire 11.

Therefore, when a user presses an "up" lever on a push-button switch, the compressed air is discharged from a source such as a compressor and is introduced into the chamber 1 of the housing 2 through the manifold 6. Accordingly, the piston 8 moves along the inner periphery of the housing 2 within a predetermined range of stroke in the left direction in FIG. 1.

The linear movement of the piston 8 causes the reel drum 12 supported by the piston 8 through the thrust bearing 10 and supported by the ball screw 5 through the ball nut 9 to be axially moved and simultaneously to be rotated. Thus, the reel drum 12 winds up the wire 11 on the outer periphery thereof.

Thus, the load or workpiece hooked on a hook assembly secured at an end of the wire 11 can be lifted.

On the contrary, upon manipulation of a "down" lever on the push button switch, the compressed air within the chamber 1 is discharged through the manifold 6 to the atmosphere. Then, the reel drum 12 is rotated while moving along the ball screw 5 in the right direction in FIG. 1, and thus, the wire 11 which has been wound on the reel drum 12 is unwound.

Accordingly, the workpiece hooked on the hook assembly can be lowered.

However, in the aforementioned air balancing hoist, if the workpiece hooked on the hook assembly is accidentally released during the lifting-up operation, the compressed air within the chamber 1 is rapidly expanded and then the reel drum 12 is rotated fast. Thus, the hook assembly is rapidly raised. Consequently, there is a problem in that upon the rapid raise of the hook assembly, the hook or a jig secured thereon may strike an operator, resulting in a safety accident.

There has been proposed some apparatuses for solving the problems. U.S. Pat. No. 5,522,581 (application Ser. No. 182,785) assigned to Zimmerman International Corporation discloses a cam-type braking mechanism for an air balancing hoist. The braking mechanism is constructed such that a cam of a braking pawl, which is mounted to a pin structure integrally secured on an end cap and can be moved in an outward radial direction due to centrifugal force upon fast rotation of the reel drum, comes into friction contact with an inner surface of the end cap to brake and finally stop the reel drum.

However, in the cam-type braking mechanism of the '581 patent, a smaller contact area for braking the reel drum is generated when the cam of the braking pawl comes into friction contact with the inner surface of the end cap upon fast rotation of the reel drum during a lifting-up operation. This results in low braking force. Thus, the fast rotating reel drum cannot be instantaneously braked, but can be completely stopped after the processes of friction contact with slippage therebetween have been repeated three or four times. Accordingly, there is a disadvantage of deterioration in safety thereof.

On the other hand, U.S. Pat. No. 5,553,832 (application Ser. No. 284,800) assigned to Knight Industries Incorporation discloses a safety device for an air balancing hoist. That is, there is provided a braking apparatus wherein a braking pawl is fixed to a side of a reel drum in such a manner that the pawl can be moved in the outward radial direction due to centrifugal force, and an inner periphery of a cylindrical sleeve surrounding the reel drum is formed with longitudinal scalloped recesses corresponding to the braking pawl so that the braking pawl can be releasably locked into the recesses due to the centrifugal force upon fast rotation of the reel drum, thereby braking the rotation of the reel drum.

However, in the safety device of the '832 patent, the recesses are formed in the inner periphery of the sleeve at a predetermined interval. Accordingly, when the braking apparatus is activated due to the fast rotation of the reel drum during the lifting-up operation and brakes the rotation of the reel drum, the reel drum cannot be instantaneously braked at portions where the recesses are not formed, and thus, continues to rotate fast. After the braking pawl comes into friction contact with the recesses only at portions where the recesses are formed, the braking pawl can brake and finally stop the reel drum. Consequently, there is also a disadvantage of deterioration in safety thereof.

SUMMARY OF THE INVENTION

Therefore, the present invention is conceived to solve the aforementioned problems in the prior art. An object of the present invention is to provide a safety device for an air balancing hoist, wherein upon fast rotation of a reel drum during a lifting-up operation, a braking pawl is locked into a braking wheel fixed to an end cap due to centrifugal force and then brakes the reel drum, thereby enhancing braking force and instantaneously braking the reel drum by means of prevention of slippage and disengagement of the pawl.

Another object of the present invention is to provide a safety device for an air balancing hoist, wherein upon fast rotation of a reel drum during a lifting-up operation, the reel drum can be instantaneously braked even at any positions within a range of lifting stroke, thereby ensuring safety to protect an operator.

A further object of the present invention is to provide a safety device for an air balancing hoist, wherein it is not necessary to machine a braking wheel and a braking pawl, thereby simplifying their configurations, reducing the number of processes, and thus, saving on the production costs.

A still further object of the present invention is to provide a safety device for an air balancing hoist, wherein it is not necessary to disassemble and reassemble the air balancing hoist in order to set a braking apparatus to an original state after braking the reel drum, and interior components such as a housing are prevented from being broken or damaged upon braking of the reel drum, thereby ensuring semipermanent use thereof.

In order to achieve the objects of the present invention, there is provided a safety device for an air balancing hoist including a housing with a chamber, which compressed air is introduced into and discharged from according to manipulation of a switch, formed therein and with end caps mounted on both ends of the housing, a piston reciprocating along an inner periphery of the housing upon supply and discharge of the compressed air to and from the chamber, a ball screw installed in the housing so that it penetrates the piston and is secured to the end caps so as not to rotate, and a reel drum with one end thereof rotatably supported by the piston through a bearing and with the other end thereof secured on a ball nut rotatably engaged with the ball screw so that the reel drum is rotated to wind up a wire when moving along the ball screw, comprising a braking wheel secured on an inner surface of the end cap and with a ratchet longitudinally formed on an outer surface of the wheel over the length corresponding to a range of movable distance of the reel drum; and a braking pawl radially pivotably mounted on a side of the reel drum to be releasably locked into the ratchet for braking the reel drum upon fast rotation of the reel drum during a lifting-up operation.

According to a preferred aspect of the present invention, the safety device for the air balancing hoist further comprises a fixing pin provided in the reel drum for preventing the braking pawl from being pivoted in a reverse direction.

According to another preferred aspect of the present invention, the safety device for the air balancing hoist further comprises an elastic member for resiliently biasing the braking pawl to an original state in which the pawl remains in non-contact with the ratchet so that the pawl can be disengaged from the ratchet after completing the braking of the reel drum by means of the releasable locking with the ratchet when braking the reel drum.

BRIEF DESCRIPTION OF THE DRAWINGS

The above object and feature of the present invention will become apparent from the following description of a preferred embodiment given in connection with the accompanying drawings, in which.

DETAILED DESCRIPTION OF THE INVENTION

Figure 1:
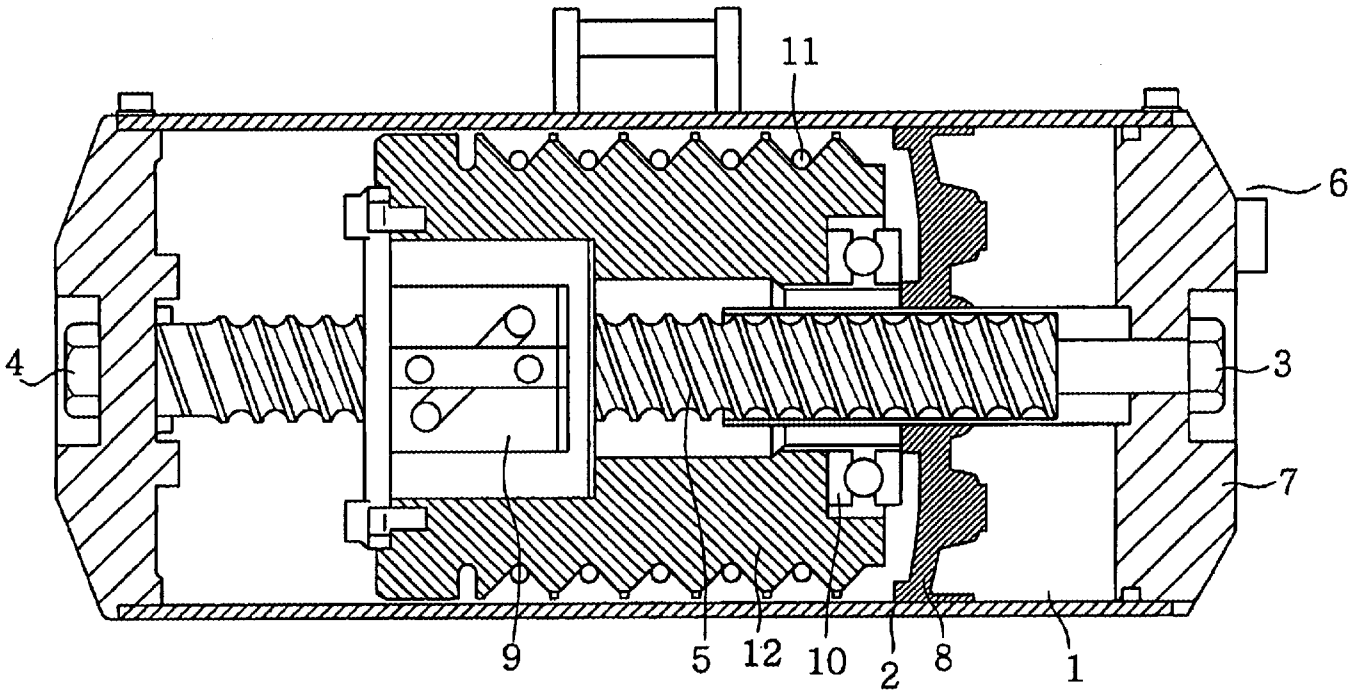
FIG. 1 PRIOR ART
FIG. 1 is a schematic sectional view of a conventional air balancing hoist.

Hereinafter, a preferred embodiment of the present invention will be described in detail with reference to the accompanying drawings. However, it is merely intended to explain the present invention to such an extent that the present invention can be easily conceived by a person having ordinary knowledge in the art to which the invention pertains. Thus, it should not be understood that the technical spirit and scope of the present invention are limited thereto.

As shown in FIGS. 2 to 5, an air balancing hoist comprises a cylindrical housing 102 with a chamber 101, which compressed air can be introduced into and discharged from by user's manipulation of the "up"/"down" levers 100*a*, 100*b* on a push-button switch 100, formed therein; an end cap 104 which is mounted to one end of the housing 102 for sealing hermetically the chamber 101 and in which a manifold 103 for introducing and discharging the compressed air into and from the chamber 101 is formed at an outer surface thereof; and a piston 105 which reciprocates along an inner periphery within a range of a predetermined stroke when the compressed air is supplied into and discharged from the chamber 101 through the manifold 103.

The constitution comprising a ball screw 106 which penetrates the piston 105 and is fixed at the inner center of the housing by fastening members B1, B2 so as not to rotate, and the reel drum 110 of which one end is rotatably supported by the piston 105 through a bearing 107, of which other end is supported by a ball nut 108 engaged with the ball screw 106, and which rotates upon movement translationally along the ball screw 106 by the actuation of the piston 105 to wind up a wire 109 thereon, is the same as the conventional hoist shown in FIG. 1. Thus, the detailed description thereof will be omitted.

That is, according to the preferred embodiment of the present invention, the cylindrical braking wheel 114 is provided. The braking wheel 114 is fixed to an inner surface of an end cap 111 mounted to the other end of the housing 102 and is accommodated into a space 112 formed in the reel drum 110. Further, at an outer surface of the wheel, the ratchet 113 is formed in a longitudinal direction over the length of movable distance of the reel drum 110.

In addition, there is provided a braking pawl 115 for braking the reel drum 110, which is mounted to a side of the reel drum 110 by a fixing pin 118 such that it can be pivoted in a radial direction. The braking pawl 115 can instantaneously brake the reel drum 110 in such a manner that a claw B thereof is pivoted on the fixing pin 118 in an inward radial direction and is releasably engaged with the ratchet 113 by centrifugal force when the reel drum 110 rapidly rotates during a lifting-up operation.

The reference numeral 119, which has not yet been illustrated, denotes fixing holes to which an elastic member 117 can be selectively fixed in order to control braking force of the braking pawl 115 to the ratchet 113 depending on the specification of the reel drum 110; the reference numeral 120 denotes a through hole for supplying the compressed air into the chamber 101 through the manifold 103; the reference numeral 130 denotes a fixing pin for fixing the braking wheel 114 so as not to move freely with respect to the end cap 111; and the reference numeral 140 denotes a rail on which a trolley fixed to the outer periphery of the housing 102 can be slid to move the air balancing hoist thereon.

Next, the operation of the safety device for the air balancing hoist of the present invention will be explained with reference to the accompanying drawings.

As shown in FIGS. 2 to 5, when the user manipulates the "up" lever 100*a,* the air compressed to a predetermined pressure is supplied from a source (not shown) to the chamber 101 of the housing 102 successively through the manifold 103 attached to the outer surface of the end cap 104 mounted to the one side of the housing 102 and the through hole 120 formed in the end cap 104. Thus, the piston 105 slides along the inner periphery of the housing 102.

Consequently, as the piston 105 moves, the reel drum 110 which is rotatably supported by the piston 105 through the bearing 107 and is supported by the ball screw 106 through the ball nut 108 can be moved along the ball screw. Then, while the reel drum 110 rotates about the ball screw 106 in its reverse rotating direction, it moves toward the left direction in FIG. 2. Thus, the wire 109 is wound onto the outer periphery of the reel drum 110.

Figure 2:
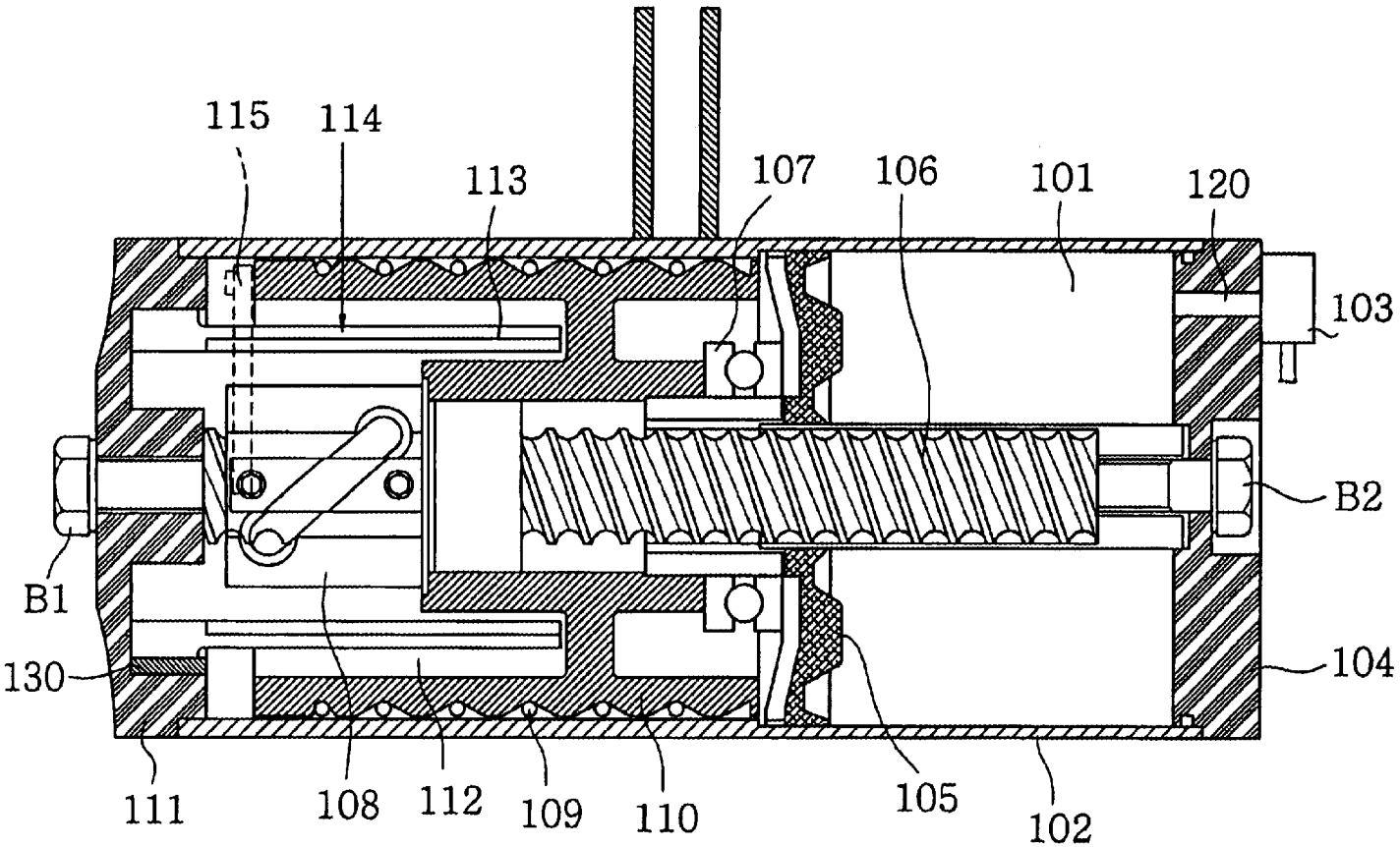
FIG. 2 is a sectional view of an air balancing hoist mounted with a safety device according to an embodiment of the present invention.
Figure 3:
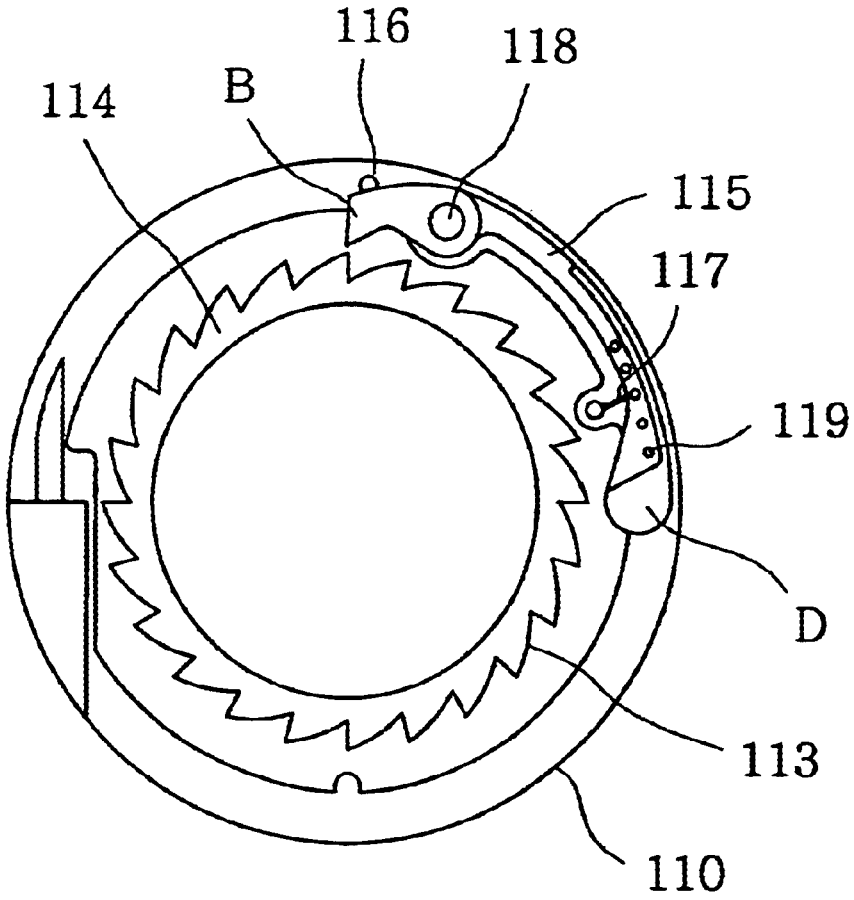
FIG. 3 is a side view of an essential portion of the safety device for the air balancing hoist according to the embodiment of the present invention.
Figure 4:
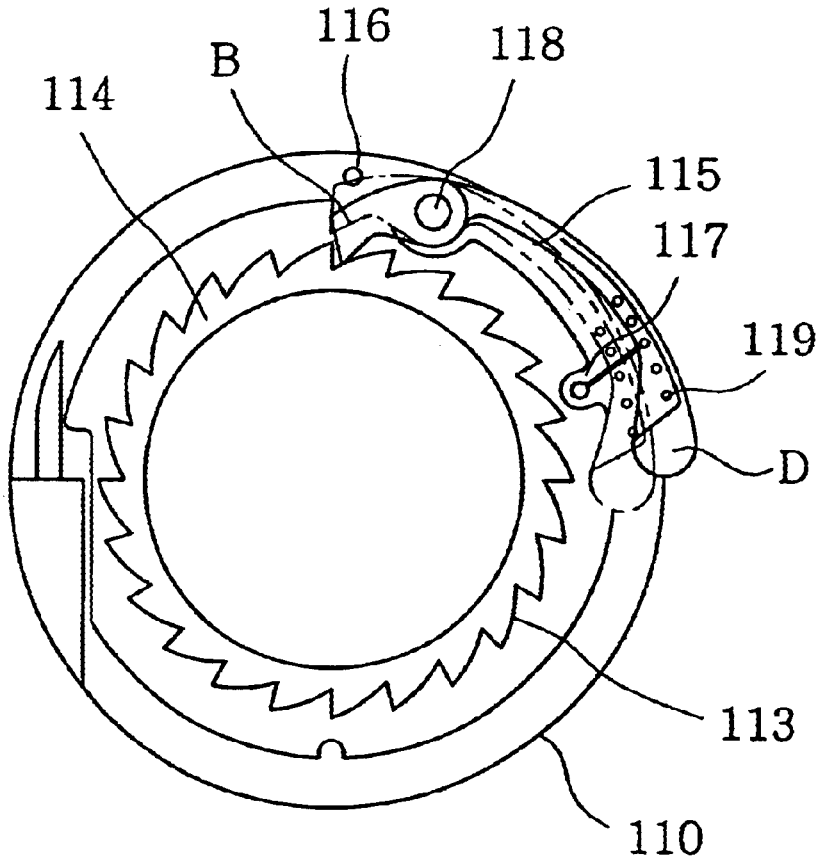
FIG. 4 is a view showing an operating state of the safety device for the air balancing hoist according to the embodiment of the present invention.
Figure 5:
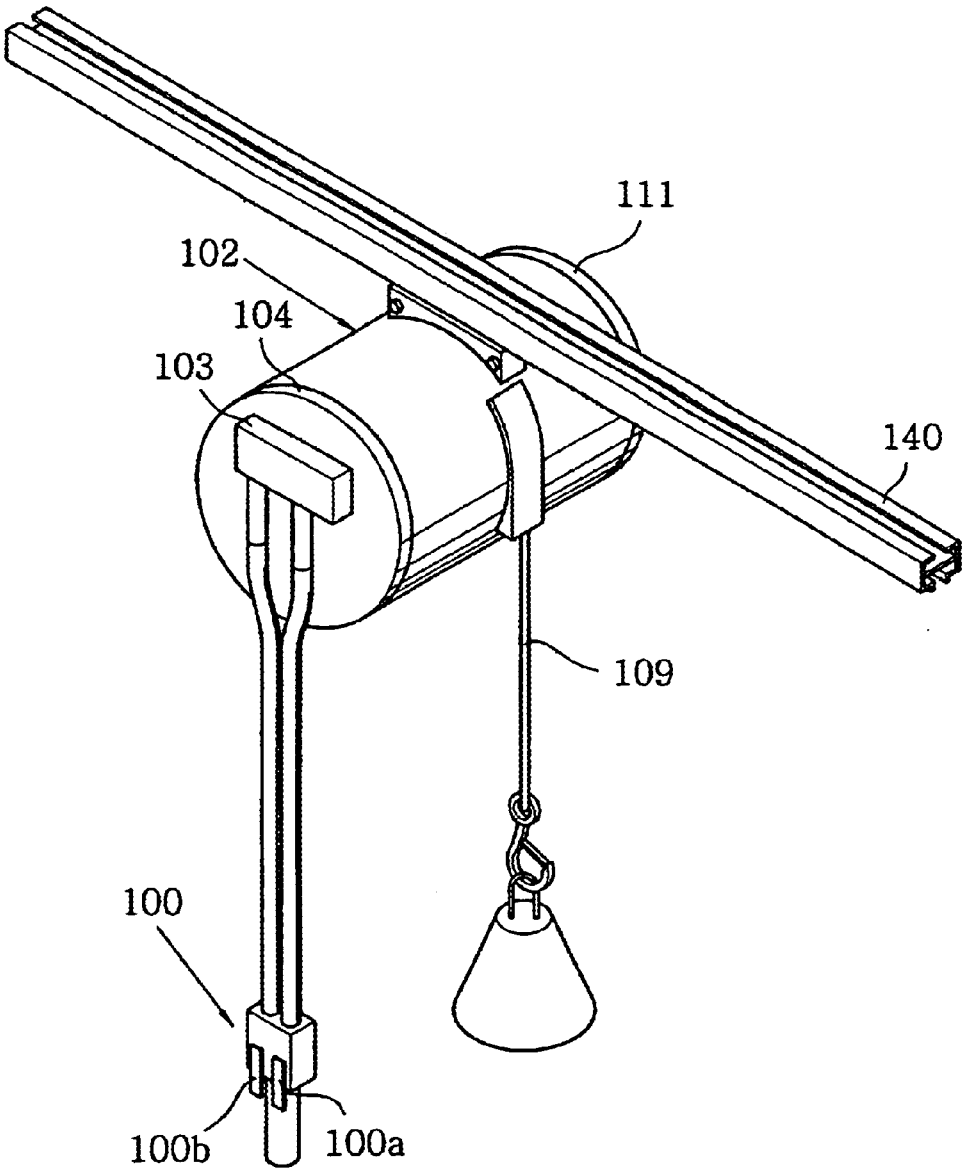
FIG. 5 is view showing an appearance of the air balancing hoist employing the safety device according to the embodiment of the present invention

On the other hand, when the compressed air is discharged from the chamber 101 to the atmosphere through the through hole 120 formed in the end cap 104 and the manifold 103 by manipulating the "down" lever 100*b* on the switch 100, the reel drum 110 rotates about the ball screw 106 in a forward rotating direction, and thus, it moves toward the right direction in FIG. 2. Therefore, a hook or hook assembly connected to the wire 109 can be lowered.

Accordingly, a predetermined lifting-up operation in which the wire is wound on and unwound from the reel drum 110 by operating the "up"/"down" levers 100*a,* 100*b* on the switch 100 can be performed.

Furthermore, if a load or workpiece is accidentally released from the hook or hook assembly connected to the wire 109 during the aforementioned lifting-up operation, the reel drum 110 is rapidly rotated due to rapid expansion of the compressed air supplied to the chamber 101 of the housing 102. In such a case, the braking pawl 115 pivotally fixed to the fixing pin 118 at one side of the reel drum 110 is locked into the ratchet 113 fixed to the end cap 111, and thus, the reel drum 110 can be instantaneously braked.

That is, since a free end D of the braking pawl 115 pivotably fixed at the side of the reel drum 110 is urged in an outward radial direction (i.e., counterclockwise direction) about the fixing pin 118 as a pivot, the claw B of the braking pawl 115 is rotated in a counterclockwise direction and is instantaneously locked into the ratchet 113 of the braking wheel 114 fixed to the end cap 111.

Therefore, even though the reel drum 110 moving along the ball screw 106 is rapidly rotated during the lifting-up operation, the reel drum 110 can be instantaneously and rapidly braked.

On the other hand, the braking state between the ratchet 113 and the braking pawl 115 which have been used for braking the reel drum 110 is released as follows. The compressed air in the chamber 101 is discharged to the atmosphere through the manifold 103 by manipulating the "down" lever 100*b* on the switch 100. Thus, the braking pawl 115 is pivoted clockwise on the fixing pin 118 by means of restoring force of the elastic member 117 with an end thereof fixed to the reel drum 110. Thus, the claw B of the braking pawl 115 is unlocked from the ratchet 113, and the braking state of the reel drum 110 is consequently released.

Therefore, the conventional operation of disassembling the air balancing hoist, releasing the braking state thereof and reassembling the air balancing hoist after fast rotation of the reel drum 110 has been braked during the lifting-up operation is not required.

As described above, according to the preferred embodiment of the present invention, the following advantages can be obtained.

Upon fast rotation of the reel drum during the lifting-up operation, the braking pawl is locked into the braking wheel fixed to the end cap due to the centrifugal force and then brakes the reel drum. Thus, braking force is enhanced and the reel drum can be instantaneously braked by means of prevention of slippage and disengagement of the pawl.

In addition, upon fast rotation of the reel drum during the lifting-up operation, the reel drum can be instantaneously braked even at any positions within a range of lifting stroke. Thus, higher safety can be ensured to protect an operator from a safety accident.

Further, it is not necessary to machine the braking wheel and the braking pawl. Thus, their configurations are simplified and the number of processes is reduced. Consequently, the production costs thereof can be reduced.

Moreover, it is not necessary to disassemble and reassemble the air balancing hoist in order to set the braking apparatus to the original state after braking the reel drum, and interior components such as the housing are prevented from being broken or damaged upon braking of the reel drum. Thus, semipermanent use thereof can be ensured.

Although the present invention has been described in connection with a preferred embodiment thereof, the present invention is not limited thereto. It can be understood by those skilled in the art that various changes and modifications can be made without departing from the spirit and scope of the present invention defined by the appended claims.

What is claimed is:

1. A safety device for an air balancing hoist including a housing (102) with a chamber (101), a switch (100) structured and arranged to introduce compressed air into and discharge the compressed air from the chamber (101), end caps (104, 111) mounted on both ends of the housing (102), a piston (105) arranged to reciprocally move along an inner periphery of the housing (102) upon supply and discharge of the compressed air to and from the chamber (101), a ball screw (106) installed in the housing (102) to penetrate the piston (105) and being secured to the end caps (104,111) against rotation, and a reel drum (110) having one end thereof rotatably supported by the piston (105) through a bearing (107) and another end thereof secured on a ball nut (108) rotatably engaged with the ball screw (106) such that the reel drum (110)13 rotated to wind up a wire (109) positioned thereabout when moving along the ball screw (106), the safety device comprising a braking wheel (114) secured on en inner surface of one (111) of the end caps (104, 111) to concentrically extend into an inner space (112) provided within the reel drum (110) and with a ratchet (113) formed on an outer surface of the wheel (114) to longitudinally extend along the outer surface of the wheel (114) in a direction of movement of the reel drum (110) along the ball screw (106) and over a length corresponding to a range of movement of the reel drum (110) along the ball screw (106), and a braking pawl (115) radially pivotally mounted on a side of the reel drum (110) to be releasably locked into the ratchet (113) for braking the reel drum (110) upon fast rotation of the reel drum (110) during a lifting-up operation, with the braking pawl (115) mounted for both rotational movement with respect to the reel drum (110) and translational movement along with the reel drum (110), and the ratchet (113) is radially inwardly mounted about the radial outer surface of the braking wheel (114) and the braking pawl (115) is mounted upon the reel drum (110) radially outwardly from the ratchet (113) and to pivot radially Inwardly to engage the ratchet (113) upon braking.

2. The safety device according to claim 1, further comprising a fixing pin (116) provided in the reel drum (110) for preventing the braking pawl (115) from being pivoted in a reverse direction.

3. The safety device according to claim 1, further comprising an elastic member (117) for resiliently biasing the braking pawl (116) to an original state in which the pawl (115) remains out of contact with the ratchet (113) such that the pawl is disengaged from the ratchet (113) to release braking of the reel drum (110).

4. The safety device according to claim 2, further comprising an elastic member (117) for resiliently biasing the braking pawl (115) to an original state in which the pawl (115) remains out of contact with the ratchet (113) such that the pawl is disengaged from the ratchet (113) to release braking of the reel drum (110).

5. The safety device according to claim 1, wherein the braking wheel (114) is affixed to an end cap (111) positioned on a side of the reel drum (110) opposite the piston (105).

6. the safety device according to claim 1, further comprising a fixing pin (118) mounted upon the reel drum (110) and upon which the braking pawl (115) is pivotally mounted, the braking pawl (115) having a claw (B) structured and arranged to pivot about the fixing pin (118) and releasably engage the ratchet (113) by centrifugal force such that the braking pawl (115) can instantaneously brake the reel drum (110) when the reel drum (110) rapidly rotates during lifting.

7. The safety device according to claim 6, further comprising an elastic member (117) for resiliently biasing the braking pawl (115) to an original state in which the pawl (115) remains out of contact with the ratchet (113) such that the pawl is disengaged from the ratchet (113) to release braking of the reel drum (110).

8. The safety device according to claim 6, wherein the braking pawl (115) further comprises a free end (0) pivotally arranged opposite the claw (B) to move in an outer radial direction about the fixing pin (115) and thereby rotate the claw (B) to lock into the ratchet (113) upon rapid rotation of the reel drum (110) due to rapid expansion of the compressed air supplied to the chamber (101) of the housing (102).

9. The safety device according to claim 8, further comprising an elastic member (117) for resiliently biasing the braking pawl (115) to an original state in which the pawl (115) remains out of contact with the ratchet (113) such that the paw!is disengaged from the ratchet (113) to release braking of the reel drum (110).

10. The safety device according to claim 9, further comprising a fixing pin (116) provided in the reel drum (110) for preventing the braking pawl (115) from being pivoted in a reverse direction.

11. the safety device according to claim 1, wherein the ratchet (113) comprises gear teeth extending radially outwardly therefrom over an axial direction of the braking wheel (114) and the direction of movement of the reel drum (110) along the ball screw (106).

12. The safety device according to claim 6, wherein the ratchet comprises gear teeth extending radially outwardly therefrom over an axial direction of the braking wheel (114) and the direction of movement of the reel drum (110) along the ball screw (106).

13. The safety device according to claim 8, wherein the ratchet (113) comprises gear teeth extending radially outwardly therefrom over an axial direction of the braking wheel (114) and the direction of movement of the reel drum (110) along the ball screw (106).

* * * * *